US008581497B1

(12) United States Patent
Xiong et al.

(10) Patent No.: US 8,581,497 B1
(45) Date of Patent: Nov. 12, 2013

(54) ELECTRONIC BALLAST CIRCUIT AND METHOD FOR DETECTING REMOVAL OF PARALLEL CONNECTED LAMP FILAMENTS IN LOW LEVEL DIMMING

(75) Inventors: Wei Xiong, Madison, AL (US); John J Dernovsek, Madison, AL (US); Candice Ungacta, Huntsville, AL (US); Danny Pugh, Harvest, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 150 days.

(21) Appl. No.: 13/315,421

(22) Filed: Dec. 9, 2011

Related U.S. Application Data

(60) Provisional application No. 61/529,108, filed on Aug. 30, 2011.

(51) Int. Cl.
*H05B 37/02* (2006.01)

(52) U.S. Cl.
USPC ..... 315/121; 315/291

(58) Field of Classification Search
None
See application file for complete search history.

(56) References Cited

U.S. PATENT DOCUMENTS

2005/0035729 A1* 2/2005 Lev et al. ..... 315/291
2010/0301754 A1* 12/2010 Bakre et al. ..... 315/121

* cited by examiner

*Primary Examiner* — Crystal L Hammond
(74) *Attorney, Agent, or Firm* — Waddey & Patterson, P.C.; Mark J. Patterson; Gary L. Montle

(57) ABSTRACT

An electronic ballast is provided with circuitry for detecting the removal of one or more lamp filaments across a range of dimming levels, and regulating an output stage including at least first and second pairs of lamp connection output terminals based on a filament connection status. A filament removal sensing circuit is coupled to the output terminal pairs and configured to generate an output voltage representative of a filament connection status with respect to the output terminal pairs. A microcontroller is coupled to receive the output voltage from the filament removal sensing circuit and programmed to determine a rate of change in the output voltage, compare the rate of change in the output voltage to a predetermined threshold value, and disable the output stage when the rate of change in the output voltage exceeds the predetermined threshold value.

20 Claims, 3 Drawing Sheets

ELECTRONIC BALLAST CIRCUIT AND METHOD FOR DETECTING REMOVAL OF PARALLEL CONNECTED LAMP FILAMENTS IN LOW LEVEL DIMMING

CROSS-REFERENCES TO RELATED APPLICATIONS

This application claims benefit of the following patent application(s) which is/are hereby incorporated by reference: U.S. Provisional Application No. 61/529,108, dated Aug. 30, 2011.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present invention relates generally to electronic ballasts and associated methods for powering lighting sources such as fluorescent lamps. More particularly, the present invention relates to an electronic ballast having circuitry for detecting the presence or removal of one or more common lamp filaments and regulating the performance of an associated output stage accordingly.

Dimming ballasts are generally desirable for, among other things, light output control and associated energy savings. If a conventional dimming ballast has a parallel connection of common lamp filaments it is very difficult to sense removal of one of the common filaments by using DC current or voltage sensing procedures as are currently known in the art. This is a primary reason why most dimming ballasts do not shut down when a common filament is removed from the ballast, meaning that there is a distinct possibility for a technician to get shocked by open circuit voltage when re-lamping. If the open circuit voltage is sufficiently high, the ballast may fail safety tests for issues such as through-lamp leakage.

BRIEF SUMMARY OF THE INVENTION

In an embodiment of the present invention, an electronic ballast is provided with circuitry for detecting the removal of one or more lamp filaments across a range of dimming levels, and regulating an output stage including at least first and second pairs of lamp connection output terminals based on a filament connection status. A filament removal sensing circuit is coupled to the output terminal pairs and configured to generate an output voltage representative of a filament connection status with respect to the output terminal pairs. A microcontroller is coupled to receive the output voltage from the filament removal sensing circuit and programmed to determine a rate of change in the output voltage, compare the rate of change in the output voltage to a predetermined threshold value, and disable the output stage when the rate of change in the output voltage exceeds the predetermined threshold value.

In another embodiment, an electronic ballast according to the present invention includes an output stage with at least first, second and third pairs of lamp connection output terminals. A first filament removal sensing circuit is coupled to the first and second output terminal pairs and configured to generate an output voltage representative of a first filament connection status, and a second filament removal sensing circuit is coupled to the second and third output terminal pairs and configured to generate an output voltage representative of a second filament connection status. A controller receives the output voltages from the first and second filament removal sensing circuits and is programmed to determine a rate of change for each of the respective output voltages, compare the determined rates of change in the output voltages to a predetermined threshold value, and disable the output stage when one or more of the rates of change in the output voltages exceeds the predetermined threshold value.

DETAILED DESCRIPTION OF THE INVENTION

Figure 1:
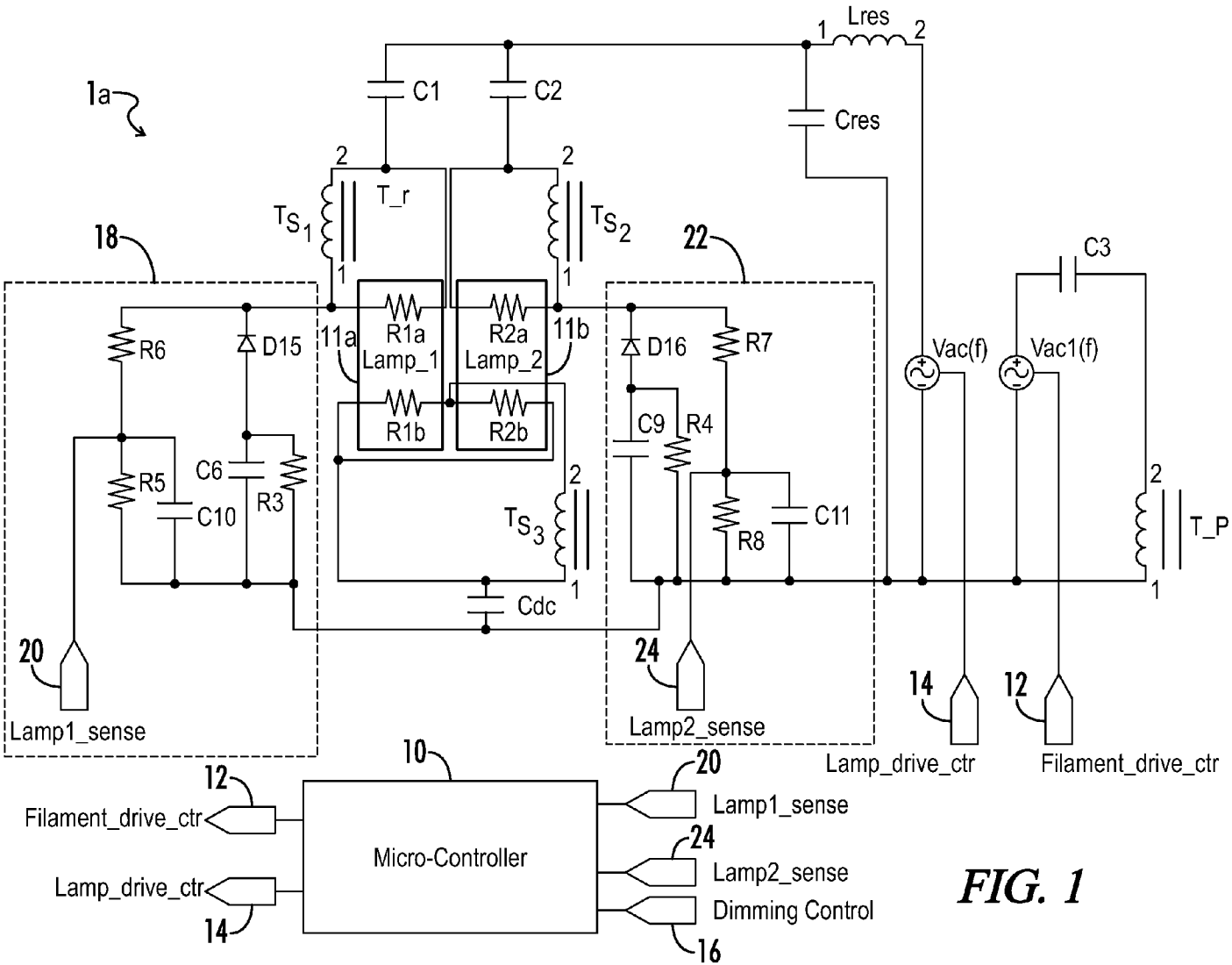
FIG. 1 is a circuit diagram representing an embodiment of an electronic ballast having circuitry in accordance with the present invention for detecting removal of one or more yellow lamp filaments in a parallel configuration.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. The term "signal" as used herein may include any meanings as may be understood by those of ordinary skill in the art, including at least an electric or magnetic representation of current, voltage, charge, temperature, data or a state of one or more memory locations as expressed on one or more transmission mediums, and generally capable of being transmitted, received, stored, compared, combined or otherwise manipulated in any equivalent manner.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

Referring generally to FIGS. 1-4, various embodiments of an electronic ballast and associated methods for detecting the removal of one or more common lamp filaments and accordingly regulating the operation of an output stage for the ballast are further described herein. The term "common" with respect to lamp filaments as used herein may typically refer to lamp filaments which are coupled in common to each other (frequently referred to in the art and herein as "yellow" filaments) rather than those that are coupled independently with respect to adjacent lamps (i.e., "red" or "blue" filaments). Where the various figures may describe embodiments sharing various common elements and features with other embodiments, similar elements and features are given the same reference numerals and redundant description thereof may be omitted below.

Referring to FIG. 1, an electronic ballast 1*a* is, in accordance with embodiments of the present invention, provided with filament removal sensing circuits 18, 22 and control circuitry 10 for disabling and enabling an output stage of the ballast in response to a determined filament status for first and second lamps Lamp1, Lamp 2 each having a common filament R1*b*, R2*b* coupled in parallel with the other.

An exemplary topology for an output stage of the ballast 1*a* as represented in FIG. 1 includes a first frequency controlled voltage source Vac(f) which is an equivalent to the output of, for example, a half-bridge inverter. The frequency of the voltage source can be modified to adjust the lamp current. A resonant tank is coupled to the voltage source Vac(f) and includes a resonant inductor Lres and a resonant capacitor Cres.

A first lamp connection branch is coupled to the resonant tank and may be defined by a DC blocking capacitor C1, a first pair of lamp connection output terminals across which a first filament R1*a* for a first lamp Lamp1 may be coupled, and a second pair of lamp connection output terminals across which a second filament R1*b* for the first lamp Lamp1 may be coupled.

A second lamp connection branch is also coupled to the resonant tank and may be defined by another DC blocking capacitor C2, a third pair of lamp connection output terminals across which a first filament R2*a* for a second lamp Lamp2 may be coupled, and the second pair of lamp connection output terminals as shared with the first branch and across which a second filament R2*b* for the second lamp Lamp2 may be coupled in parallel with the second filament R1*b* for the first lamp Lamp1.

A second frequency controlled AC voltage source Vac1(*f*) may further be provided to drive filament heating. The frequency of the second voltage source Vac1(*f*) can be modified such that the voltage across a primary winding Tp of a filament heating transformer can be adjusted, as well as the voltage across a plurality of auxiliary (secondary) windings including a first auxiliary winding Ts1 for heating filament R1*a*, a second auxiliary winding Ts2 for heating filament R2*a* and a third auxiliary winding Ts3 for heating filaments R1*b* and R2*b*. A resonant capacitor C3 is coupled in series with the primary winding Tp.

Control circuitry 10 is used to adjust the frequency of the first and second voltage sources Vac(f) and Vac1(*f*) according to an input dimming control signal. The terms "control circuit" or "controller" as used herein may refer to at least a microcontroller, a general microprocessor, an application specific integrated circuit (ASIC), a digital signal processor (DSP), a field programmable gate array, or various alternative blocks of discrete circuitry as known in the art, designed to perform functions as further defined herein.

The exemplary topology for an electronic ballast 1*a* as described above and represented in FIG. 1 is not intended as limiting on the scope of the present invention unless otherwise stated, as filament removal sensing circuits and associated control circuitry may in accordance with the present invention be provided for a number of equivalent ballast topologies as may be understood by one of skill in the art.

The common (yellow) filaments R1*b*, R2*b* of the two lamps, respectively, as shown in FIG. 1 are coupled in parallel such that if one common filament is removed from the circuit, conventional filament sensing methods such as pushing a DC current through the filaments will not be effective. What is more, because the operating frequency is typically relatively high (far away from the resonant frequency of the tank) in the low level dimming mode, the output lamp voltage may not be substantially modified if a lamp is disconnected from the inverter. Therefore, lamp voltage sensing would also be insufficient for common filament removal.

In an embodiment of the present invention as represented in FIG. 1, a first filament removal sensing circuit 18 and a second filament removal sensing circuit 22 collectively define a parallel lamp filament removal sensing circuit. Circuits 18, 22 are coupled to the first lamp connection branch and the second lamp connection branch, respectively. A DC blocking capacitor Cdc is coupled on a first end to one end of the third auxiliary winding Ts3. The first filament removal sensing circuit 18 is coupled on a first end to the first pair of lamp connection output terminals and on a second end to a second end of the DC blocking capacitor Cdc. The second filament removal sensing circuit 22 is coupled on a first end to the third pair of lamp connection output terminals and on a second end to the second end of the DC blocking capacitor Cdc.

Figure 2:
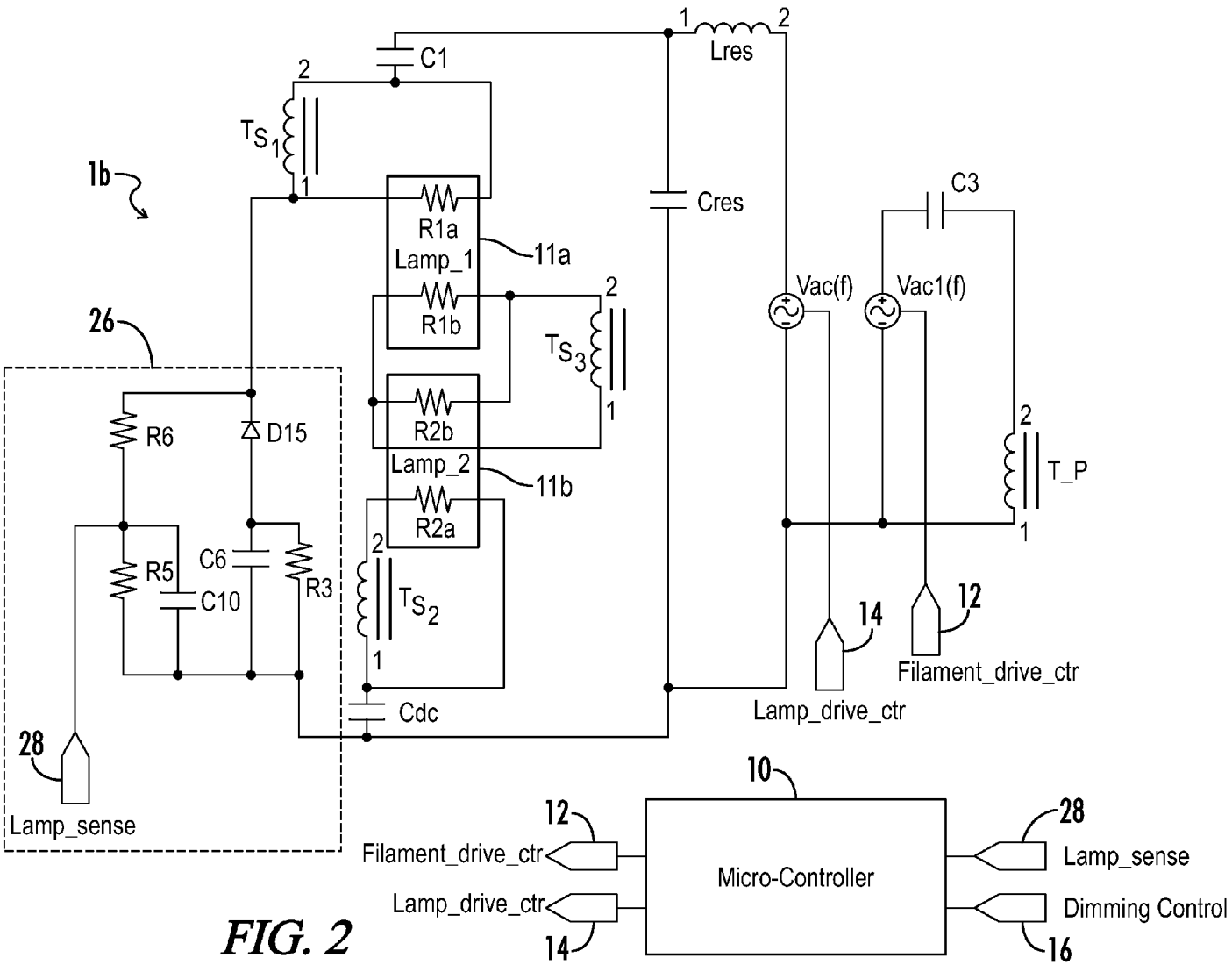
FIG. 2 is a circuit diagram representing an embodiment of an electronic ballast having circuitry in accordance with the present invention for detecting removal of one or more yellow lamp filaments in a series configuration.

In another embodiment of an electronic ballast topology 1*b* as represented in FIG. 2, the output stage of the ballast includes a single lamp connection branch coupled to the resonant tank. The output stage includes DC blocking capacitor C1, a first pair of lamp connection output terminals across which a first filament R1*a* for a first lamp Lamp1 may be coupled, a second pair of lamp connection output terminals across which a second filament R1*b* for the first lamp Lamp1 and a second filament R2*b* for the second lamp Lamp2 may be coupled in parallel with each other, a third pair of lamp connection output terminals across which a first filament R2*a* for the second lamp Lamp2 may be coupled (and wherein the lamps may be coupled to the output stage in series rather than in parallel), and DC blocking capacitor Cdc. One filament removal sensing circuit 26 defining a series lamp filament removal sensing circuit is coupled on first and second ends to the first pair of lamp connection output terminals and the DC blocking capacitor Cdc, respectively.

The structure and operation of the respective filament removal sensing circuits 18, 22, 26 may differ with respect to their application in a parallel- or series-configured ballast topology, but otherwise may be described in equivalent fashion below.

Referring again to the first filament removal sensing circuit 18 in the embodiment shown in FIG. 1, a first branch including resistors R5, R6 and capacitor C10 is used to sense DC voltage across Lamp1. Capacitor Cdc, and a second branch including diode D15, capacitor C8 and resistor R3 are used to sense open circuit lamp current. The second filament removal sensing circuit 22 has a first branch including resistors R7, R8 and capacitor C11 to sense DC voltage across Lamp2 and the capacitor Cdc, and a second branch including diode D16, capacitor C9 and resistor R4 to sense open circuit lamp current.

In a normal low level dimming condition, most of the lamp current passes through the lamp (using Lamp1 for this example) because the lamp impedance is substantially lower than the impedance of the diode D15 in series with capacitor C6 and resistor R3. The voltage across the capacitor C10 would be small or close to zero depending on the ratio between capacitors C1 and Cdc.

When a common filament is removed (for example, the common filament R1*b* of Lamp1) from the output stage, the lamp stops conducting current immediately such that all of the current has to be bypassed by the first filament removal sensing circuit 18. The impedance of capacitor C6 and resistor R3 can be set much lower than that of the first branch (i.e., R6, R5, C10) wherein a large positive voltage appears across the first filament removal sensing circuit 18 generally, and more particularly across capacitor C10.

Figure 3:
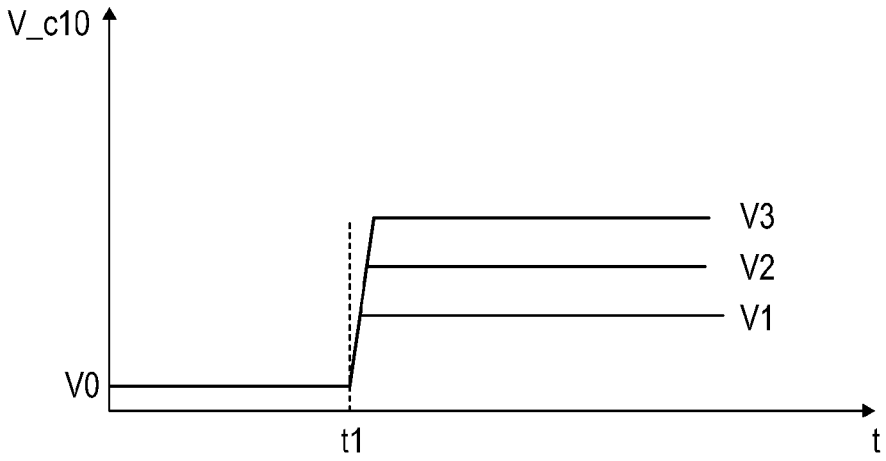
FIG. 3 is a graphical diagram representing an exemplary voltage transition from a normal condition to a filament removal condition in filament removal detection circuitry according to the present invention.

Referring to FIG. 3, the transition of the voltage across the capacitor C10 is represented from a normal condition to a common filament removal condition (at time t1). Before the time t1 the voltage V_C10 across the capacitor C10 (i.e., the output voltage from the filament removal sensing circuit being representative of a filament status) is a very small voltage v0. After time t1, the voltage across the capacitor C10 increases quickly to a new voltage which may be for example v1, v2, v3, etc., depending upon the dimming lamp current level before filament removal. The higher the lamp current, the higher the voltage V_C10 (the output voltage from the circuit 18) will be after removal of the common filament.

As shown in FIG. 3, the steady state voltage of the voltage V_C10 after removal of the common filament cannot be used with respect to a predetermined threshold value to sense this abnormal condition because the voltage V_C10 is a variable. But the quick increase in the output voltage V_C10 will be present for the various dimming levels. The rate of change dv/dt of the output voltage V_C10 may accordingly be used to sense the transition of common filament removal. The controller 10 (e.g., a typical microcontroller) may be programmed to sense this rate of change dv/dt for the purpose of detecting this transition.

Figure 4:
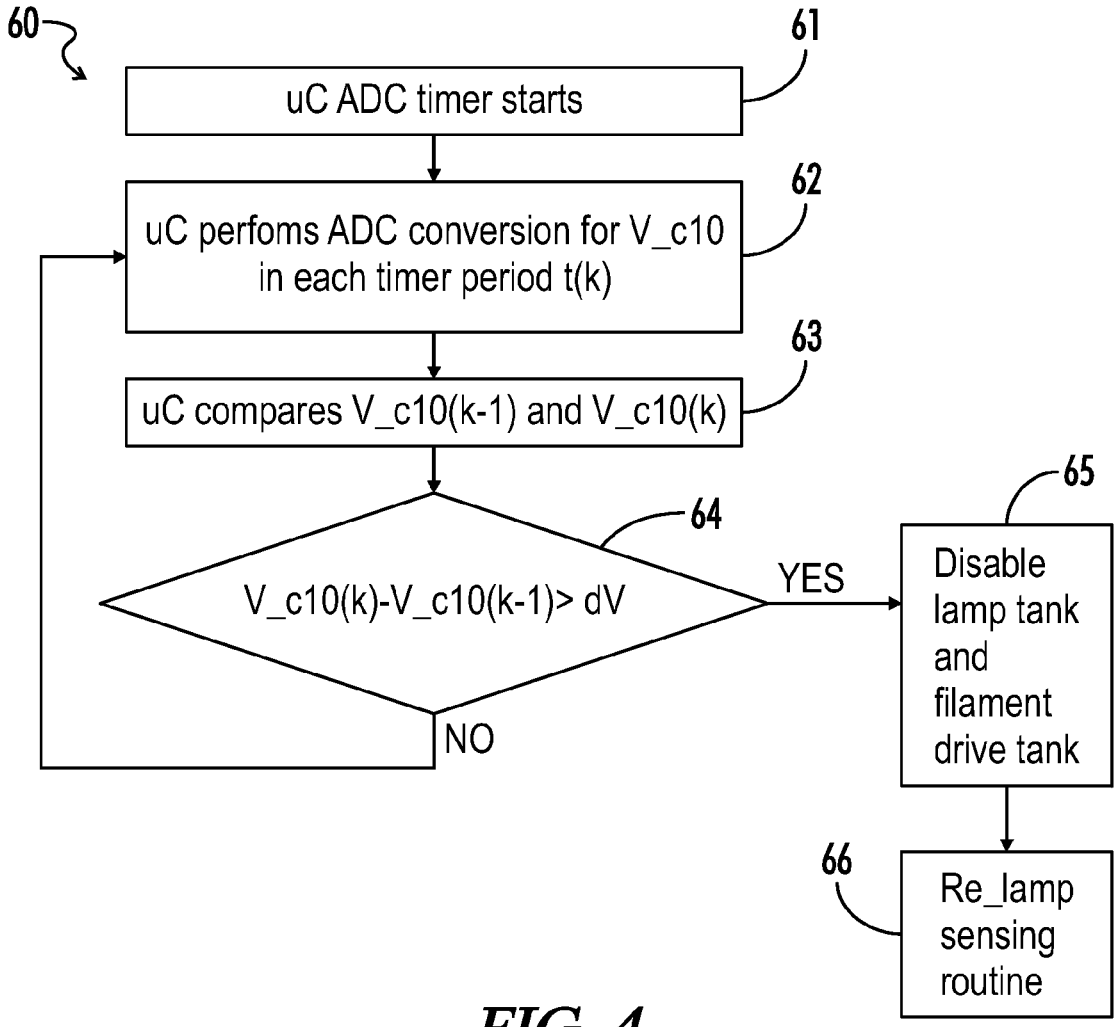
FIG. 4 is a flowchart representing an exemplary method of operation for an electronic ballast having yellow filament removal detection circuitry according to the present invention.

Referring now to FIG. 4, a method 60 of detecting filament removal in accordance with the present invention may now be described. Unless otherwise stated, the steps recited herein are exemplary only and are not intended as limiting on the scope of the present invention. Certain steps may be omitted as redundant in various embodiments, or substituted for an equivalent step or process.

The controller begins by starting an internal ADC timer (step 61) to count off a particular time period t(k).

The filament removal sensing circuit generates an output voltage V_C10 representative of a filament status for a common lamp filament to which the circuit is coupled. The controller then receives the output voltage V_C10 from the filament removal sensing circuit (and further V_C11 where the second filament removal sensing circuit is present) and performs an ADC conversion for each timer period t(k) (step 62).

An output voltage for a first (e.g., immediately preceding) time period V_C10($k$−1) is compared to the output voltage for a second (e.g., current) time period V_C10($k$) (step 63).

If a difference between the second (current) output voltage V_C10($k$) and the first (immediately preceding) output voltage V_C10($k$−1) is determined to be less than a predetermined threshold value dv (i.e., "no" in response to the query of step 64), then a calculated rate of change for the output voltage may be determined as less than a predetermined rate of change threshold value, consistent with a first filament status of being coupled to the ballast, and the process returns to step 62.

If the difference between the second (current) output voltage V_C10($k$) and the first (immediately preceding) output voltage V_C10($k$−1) is determined to be greater than the predetermined threshold value dv (i.e., "yes" in response to the query of step 64), then the calculated rate of change for the output voltage may be determined as greater than a predetermined rate of change threshold value, consistent with a second filament status wherein the common filament is removed from the ballast. The process continues to step 65, wherein the controller disables the first voltage source Vac(f) and the second voltage source Vac1($f$), effectively disabling the lamp tank and the filament drive tank of the electronic ballast.

The controller may then execute a re-lamp sensing routine (step 66) to determine when a lamp has been properly positioned with respect to the lamp output connection terminals, after which the first voltage source Vac(f) and the second voltage source Vac1($f$) are enabled, effectively enabling the lamp tank and the filament drive tank of the electronic ballast.

In an embodiment (not shown) the method may further include steps for switching a flag or an equivalent between a first state associated with a first filament status and a second state associated with a second status. The controller may set the flag from the first state to a second state upon disabling the lamp tank and the filament drive tank. When a filament connected status has been detected pursuant to the re-lamp routine and the tanks enabled, the controller may be further programmed to set the flag from the second state to the first state, wherein the controller returns to executing the method in the manner initially described above.

The previous detailed description has been provided for the purposes of illustration and description. Thus, although there have been described particular embodiments of the present invention of a new and useful "Electronic Ballast and Method for Detecting Lamp Filament Removal in Low Level Dimming Conditions," it is not intended that such references be construed as limitations upon the scope of this invention except as set forth in the following claims.

What is claimed is:

1. An electronic ballast comprising:

an output stage comprising at least first and second pairs of lamp connection output terminals;

a filament removal sensing circuit coupled to the at least first and second output terminal pairs and configured to generate an output voltage representative of a filament connection status with respect to the output terminal pairs; and a controller coupled to receive the output voltage from the filament removal sensing circuit and further effective to determine a rate of change in the output voltage, compare the rate of change in the output voltage to a predetermined threshold value, disable the output stage when the rate of change in the output voltage exceeds the predetermined threshold value.

2. The electronic ballast of claim 1, wherein the controller is effective to determine the rate of change in the output voltage by determining a first output voltage with respect to a first time period;

determining a second output voltage with respect to a second time period immediately following the first time period;

subtracting the first output voltage from the second output voltage.

3. The electronic ballast of claim 2, the filament removal sensing circuit comprising a first circuit branch having a first impedance greater than a lamp impedance during a normal filament connection status, and a second circuit branch having a second impedance greater than the impedance of the first circuit branch, the output voltage from the filament removal sensing circuit being determined with respect to the second circuit branch.

4. The electronic ballast of claim 2, the output stage of the electronic ballast further comprising a lamp driving circuit effective to provide a lamp driving current through one or more lamps coupled between the first and second pairs output terminals, and a filament driving circuit effective to provide a filament heating voltage across the respective first and second pairs of output terminals.

5. The electronic ballast of claim 4, the filament driving circuit further comprising a primary winding coupled across a filament driving voltage source and plurality of secondary windings magnetically coupled to receive filament heating voltage from the primary winding, the secondary windings comprising a first winding coupled across the first pair of output terminals in association with a first lamp connection, a second winding coupled across the second pair of output terminals in association with a second lamp connection, and a third winding coupled across a third pair of output terminals associated with each of the first and second lamp connections.

6. The electronic ballast of claim 4, wherein the filament removal sensing circuit is coupled on a first end to the first pair of output terminals and on a second end to the second pair of output terminals, and wherein the output stage is configured to power first and second lamps coupled in series via the third pair of output terminals.

7. The electronic ballast of claim 4, the filament removal sensing circuit further comprising a first filament removal sensing circuit coupled on a first end to the first pair of output terminals and on a second end to the third pair of output terminals, the ballast further comprising a second filament removal sensing circuit coupled on a first end to the second pair of output terminals and on a second end to the third pair of output terminals, wherein the output stage is configured to power first and second lamps coupled in parallel.

8. An electronic ballast comprising:

an output stage comprising at least first, second and third pairs of lamp connection output terminals;

a first filament removal sensing circuit coupled to the first and second output terminal pairs and configured to generate an output voltage representative of a first filament connection status;

a second filament removal sensing circuit coupled to the second and third output terminal pairs and configured to generate an output voltage representative of a second filament connection status; and a controller coupled to receive the output voltages from the first and second filament removal sensing circuits and further effective to determine a rate of change for each of the respective output voltages, compare the determined rates of change in the output voltages to a predetermined threshold value, and disable the output stage when one or more of the rates of change in the output voltages exceeds the predetermined threshold value.

9. The electronic ballast of claim 8, wherein the controller is effective to determine the rate of change for each of the respective output voltages by determining a first output voltage with respect to a first time period, determining a second output voltage with respect to a second time period immediately following the first time period, and subtracting the first output voltage from the second output voltage.

10. The electronic ballast of claim 9, one or more of the first and second filament removal sensing circuits further comprising a first circuit branch having a first impedance greater than a lamp impedance during a normal filament connection status, and a second circuit branch having a second impedance greater than the impedance of the first circuit branch, the output voltage from the respective filament removal sensing circuit being determined with respect to the second circuit branch.

11. The electronic ballast of claim 9, the output stage of the electronic ballast further comprising a lamp driving circuit effective to provide a lamp driving current through one or more lamps coupled between the first and second pairs of output terminals and one or more lamps coupled between the second and third pairs of output terminals, and a filament driving circuit effective to provide a filament heating voltage across the respective first, second and third pairs of output terminals.

12. The electronic ballast of claim 11, the filament driving circuit further comprising a primary winding coupled across a filament driving voltage source and a plurality of secondary windings magnetically coupled to receive filament heating voltage from the primary winding, the secondary windings comprising a first winding coupled across the first pair of output terminals in association with a first lamp connection, a second winding coupled across the second pair of output terminals in association with a second lamp connection, and a third winding coupled across the third pair of output terminals associated with each of the first and second lamp connections.

13. The electronic ballast of claim 12, the filament removal sensing circuit further comprising a first filament removal sensing circuit coupled on a first end to the first pair of output terminals and on a second end to the third pair of output terminals, the ballast further comprising a second filament removal sensing circuit coupled on a first end to the second pair of output terminals and on a second end to the third pair of output terminals, wherein the output stage is configured to power first and second lamps coupled in parallel.

14. A method of sensing and responding to filament removal from an electronic ballast having an output stage with at least first and second pairs of lamp connection output terminals, the method comprising:

generating an output voltage representative of a filament connection status with respect to the first and second output terminal pairs;

receiving the output voltage at a controller;

determine a rate of change in the output voltage;

comparing the rate of change in the output voltage to a predetermined threshold value; and disabling the output stage when the rate of change in the output voltage exceeds the predetermined threshold value.

15. The method of claim 14, the step of determining a rate of change in the output voltage further comprising:

determining a first output voltage with respect to a first time period;

determining a second output voltage with respect to a second time period immediately following the first time period; and subtracting the first output voltage from the second output voltage.

16. The method of claim 15, further comprising the steps of providing a lamp driving current through one or more lamps coupled between the first and second pairs output terminals, and providing a filament heating voltage across the respective first and second pairs of output terminals.

17. The method of claim 16, the step of providing a filament heating voltage across the respective first and second pairs of output terminals further comprising generating a filament heating voltage across a first winding coupled across the first pair of output terminals in association with a first lamp connection;

generating the filament heating voltage across a second winding coupled across the second pair of output terminals in association with a second lamp connection; and generating the filament heating voltage across a third winding coupled across a third pair of output terminals associated with each of the first and second lamp connections.

18. The method of claim 17, further comprising the step of providing a filament removal sensing circuit effective to generate the output voltage representative of a filament connection status and comprising a first circuit branch having a first impedance greater than a lamp impedance during a normal filament connection status, and a second circuit branch having a second impedance greater than the impedance of the first circuit branch, the output voltage from the filament removal sensing circuit being determined with respect to the second circuit branch.

19. The method of claim 14, further comprising the steps of:

executing a re-lamp sensing routine effective to determine when a lamp has been properly repositioned with respect to the lamp output connection terminals;

enabling the output stage in response to determining the lamp has been properly repositioned.

20. The method of claim 19, further comprising the steps of:

switching a flag from a first state associated with a first filament status to a second state associated with a second status upon disabling the output stage; and switching the flag from the second state to the first state in response to determining the lamp has been properly repositioned pursuant to the re-lamp sensing routine.

* * * * *